US007712916B2

(12) United States Patent
Hahn et al.

(10) Patent No.: US 7,712,916 B2
(45) Date of Patent: May 11, 2010

(54) PORTABLE REDUCED-EMISSIONS WORK LIGHT

(75) Inventors: Steven Jay Hahn, Lake Wylie, SC (US); Bradley Robert Kokoski, Charlotte, NC (US)

(73) Assignee: Jameson, LLC, Clover, SC (US)

( * ) Notice: Subject to any disclaimer, the term of this patent is extended or adjusted under 35 U.S.C. 154(b) by 368 days.

(21) Appl. No.: 11/306,021

(22) Filed: Dec. 14, 2005

(65) Prior Publication Data

US 2008/0101060 A1 May 1, 2008

(51) Int. Cl.
*F21L 14/00* (2006.01)

(52) U.S. Cl. ..... 362/208; 362/451; 362/260

(58) Field of Classification Search ..... 362/208, 362/293, 186, 369, 451, 260; 315/33, 51, 315/56, 72

See application file for complete search history.

(56) References Cited

U.S. PATENT DOCUMENTS 2,233,280 A 2/1941 Barnes
4,782,429 A * 11/1988 Walton et al. ..... 362/20
4,945,461 A 7/1990 Crates
5,043,530 A 8/1991 Davies
5,262,592 A 11/1993 Aldissi
5,528,477 A 6/1996 Carmo
5,564,821 A 10/1996 Hesprich
5,596,247 A * 1/1997 Martich et al. ..... 315/56
5,738,438 A 4/1998 Hesprich
5,765,941 A 6/1998 Vest
5,818,675 A * 10/1998 Lu ..... 361/93.9
5,860,730 A 1/1999 Hesprich
6,005,191 A 12/1999 Tzeng et al.
6,169,373 B1 1/2001 Riesinger
6,964,495 B2 11/2005 Schnaufer et al.
2002/0172037 A1 * 11/2002 Schnaufer et al. ..... 362/221

OTHER PUBLICATIONS

Pauluhn Light; Bruce Industries, Inc.; Published prior to May 21, 2001.

* cited by examiner

*Primary Examiner*—Sharon E Payne
(74) *Attorney, Agent, or Firm*—Adams Intellectual Property Law

(57) ABSTRACT

A reduced emissions work light that includes a bulb having an elongated bulb tube, a handle adjacent the bulb and adapted for being gripped by a user to manipulate the work light, an emissions containment housing positioned adjacent the bulb tube, and an integrated ballast and filter assembly. The integrated ballast and filter assembly is located within the housing and operatively connected to the bulb for providing voltage to the bulb and reducing emissions generated by the work light.

17 Claims, 17 Drawing Sheets

18

PORTABLE REDUCED-EMISSIONS WORK LIGHT

TECHNICAL FIELD AND BACKGROUND OF THE INVENTION

This invention relates to a portable, reduced-emissions work light. The invention has particular application for military use in special purpose tents, referred to as modular command post shelters (MCPS), and other mobile military systems. The invention meets military requirements for electromagnetic interference (EMI) emissions, and includes shock-absorbing components which protect the light from damage caused by dropping or other sudden impact. The invention is lightweight and may include a convenient handle at one or both ends. In addition, the invention includes snap-together components which enable quick and convenient assembly and disassembly. The light includes an integrated power supply and EMI filter.

SUMMARY OF THE INVENTION

Therefore, it is an object of the invention to provide a portable, hand-held work light which generates reduced emissions.

It is another object of the invention to provide a work light which is especially applicable for military use, and which meets military specifications for EMI emissions.

It is another object of the invention to provide a work light which does not interfere with the performance of equipment which may be potentially sensitive to magnetic fields.

It is another object of the invention to provide a work light which is relatively lightweight.

It is another object of the invention to provide a work light which includes snap-together components for ready assembly and disassembly.

It is another object of the invention to provide a work light which enables convenient and safe removal and replacement of a defective or inoperative ballast.

It is another object of the invention to provide a work light which generates a minimum of five-foot candles of light at 30 inches off the ground.

It is another object of the invention to provide a work light which is impact resistant.

It is another object of the invention to provide a work light having a ballast that can operate at multiple voltages.

It is another object of the invention to provide lighting for a mobile shelter, such as a military MCPS, which would include one or more reduced emissions work lights.

It is another object of the invention to provide a mobile shelter which includes an energy efficient lighting system.

These and other objects and advantages of the present invention are achieved in the preferred embodiment set forth below by providing a reduced emissions work light. The work light includes a bulb having an elongated bulb tube, a handle adjacent the bulb and adapted for being gripped by a user to manipulate the work light, an emissions containment housing positioned adjacent the bulb tube, and an integrated ballast and filter assembly. The integrated ballast and filter assembly is located within the housing and operatively connected to the bulb for providing voltage to the bulb and reducing emissions generated by the work light.

According to one preferred embodiment of the invention, a light-transmitting bulb shield surrounds the bulb tube to protect the bulb from damage.

According to another preferred embodiment of the invention, a cylindrical shock-absorbing plug is positioned within the bulb shield and engages a free end of the bulb tube to further protect the bulb from damage.

According to yet another preferred embodiment of the invention, the plug includes an interior web for being gripped to remove the plug from the bulb shield.

According to yet another preferred embodiment of the invention, a shock-absorbing end cap is positioned over an end of the bulb shield opposite the handle.

According to yet another preferred embodiment of the invention, a switch opening is formed in the emissions containment housing to accommodate a ballast activation switch in the handle.

According to yet another preferred embodiment of the invention, a removable color filter is positioned over the bulb shield to filter light emitted by the bulb.

According to yet another preferred embodiment of the invention, a phototriac switch allows the work light to operate at multiple voltage inputs.

According to yet another preferred embodiment of the invention, the reduced emissions work light includes a bulb having an elongated bulb tube, a handle adjacent the bulb and adapted for being gripped by a user to manipulate the work light, an emissions containment housing positioned adjacent the bulb tube having a predetermined interior void, and an integrated ballast and filter assembly. The integrated ballast and filter assembly is intended to correspond with the interior void in the housing, and occupy substantially all of the interior volume of the housing.

According to yet another preferred embodiment of the invention, the ballast includes electrical wires having respective terminal ends operatively connected to respective pins of the bulb.

According to yet another preferred embodiment of the invention, a bulb socket is located between the fluorescent bulb and the ballast. The bulb socket defines a plurality of longitudinal through-bores receiving respective wire ends of the ballast from a first end thereof and respective electrode pins of the bulb from an opposite second end thereof.

According to yet another preferred embodiment of the invention, the bulb socket includes enlarged conical openings at the first end thereof. The enlarged openings are adapted for receiving respective electrode pins into the longitudinal through-bores.

According to yet another preferred embodiment of the invention, the bulb socket is formed of a molded plastic material.

According to yet another preferred embodiment of the invention, a cylindrical resilient shock is formed around the bulb socket at an open proximal end of the cup.

According to yet another preferred embodiment of the invention, a transistor is connected to a zener diode to control a phototriac switch, allowing the work light to operate on multiple voltage inputs.

According to yet another preferred embodiment of the invention, the reduced emissions work light includes a bulb having an elongated bulb tube, a handle adjacent the bulb and adapted for being gripped by a user to manipulate the work light, an emissions containment housing is positioned adjacent the bulb tube having a predetermined interior void, and an integrated ballast and filter assembly. The integrated ballast and filter assembly is intended to correspond with the interior void in the housing, and occupy substantially all of the interior volume of the housing. In addition, a transistor is connected to a zener diode to control a phototriac switch allowing the work light to operate on multiple voltage inputs.

According to yet another preferred embodiment of the invention, a light reflector is located adjacent the bulb tube for enhancing illumination of the bulb.

According to yet another preferred embodiment of the invention, an elongated pull strip is releasably attached to the bulb for removing the bulb from the work light for replacement.

According to yet another preferred embodiment of the invention, a power supply cord is adapted for being connected to a power source to supply electrical power to the work light.

According to yet another preferred embodiment of the invention, a varistor is operatively connected to the assembly for protecting the assembly from a large transient voltage or power surge.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF THE PREFERRED EMBODIMENT AND BEST MODE

Figure 1:
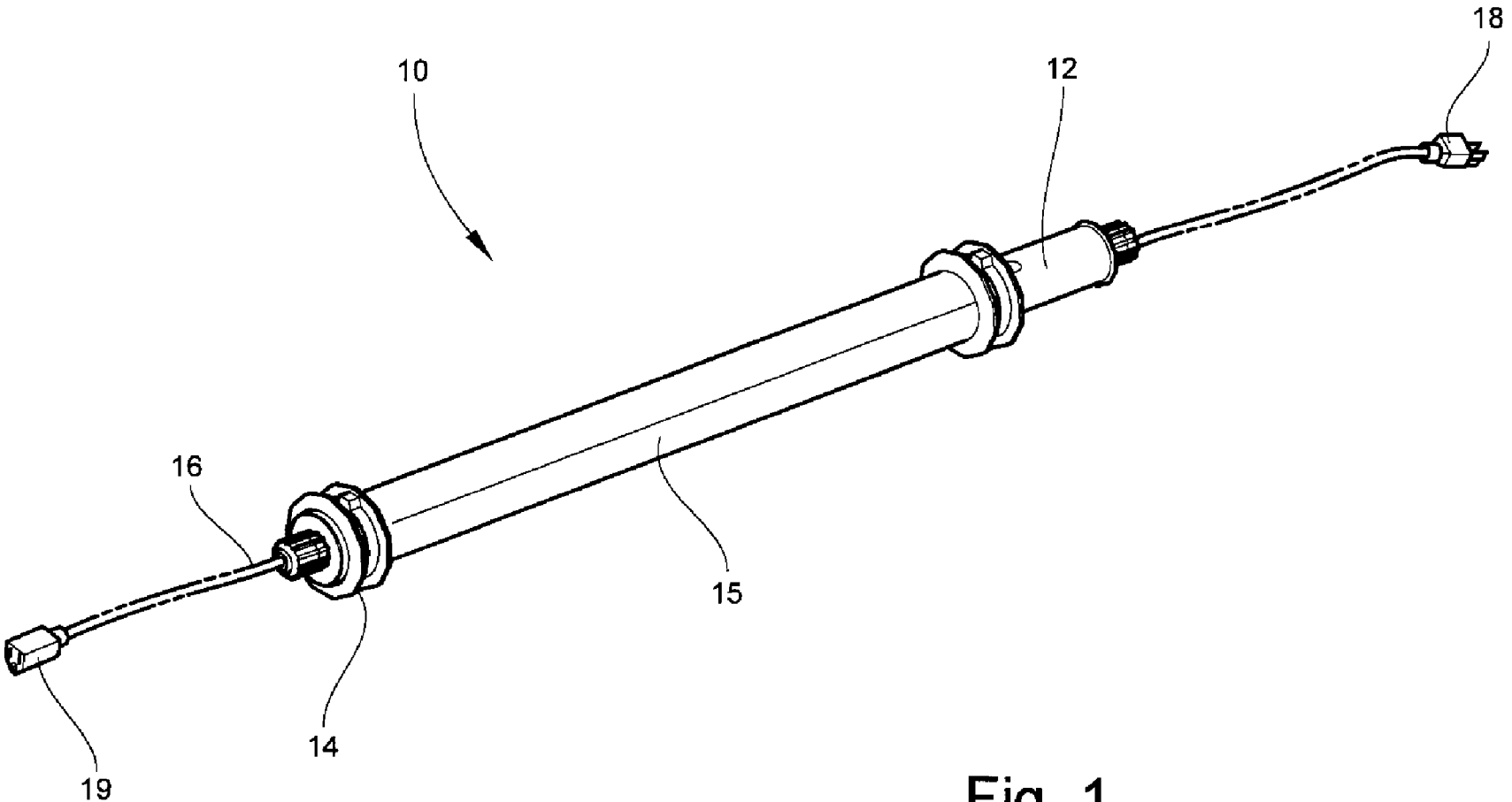
FIG. 1 is a perspective view of a reduced emissions work light according to one preferred embodiment of the invention.
Figure 2:
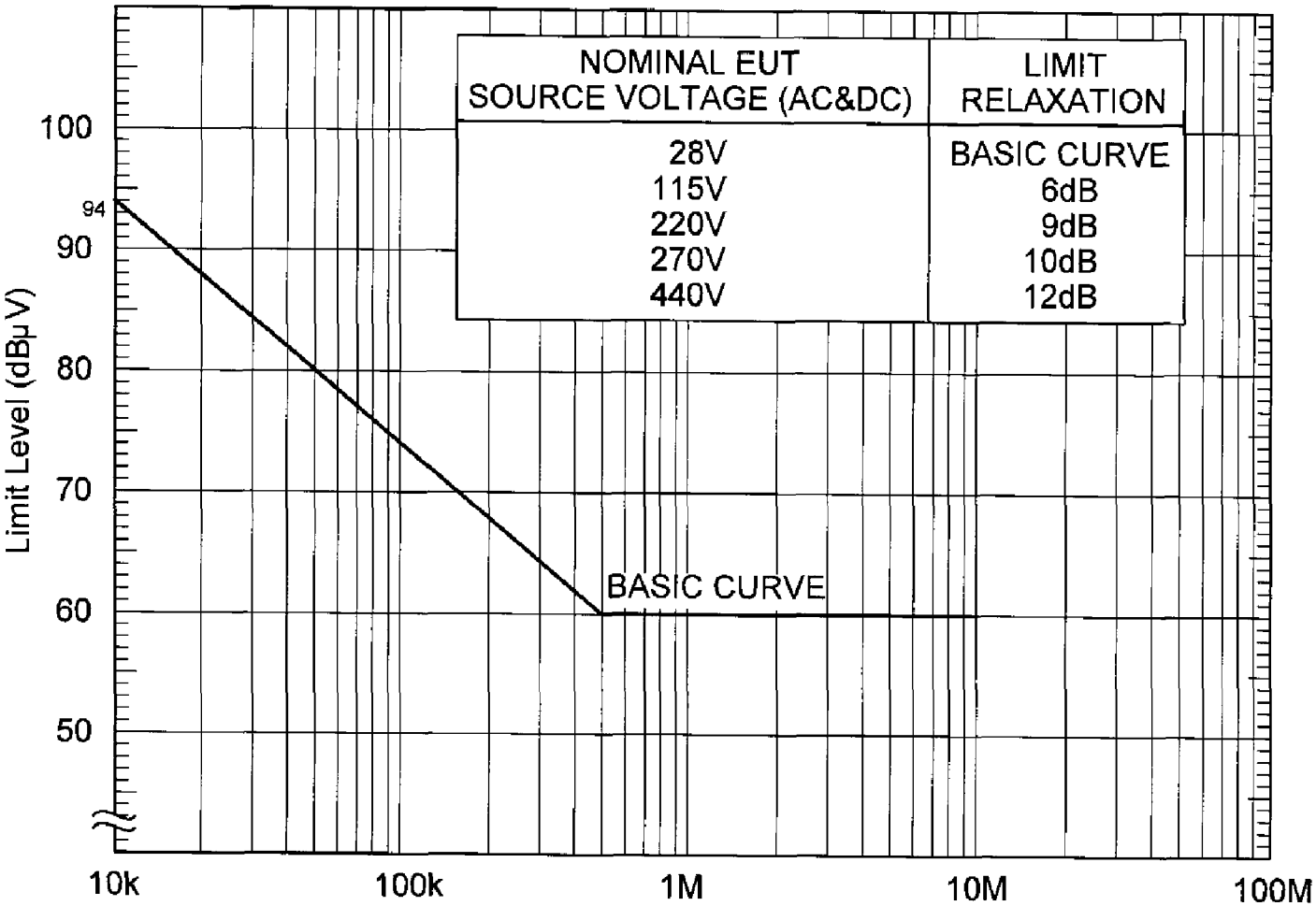
FIG. 2 is a graph illustrating certain military requirements for conducted emissions applicable to the work light.
Figure 3:
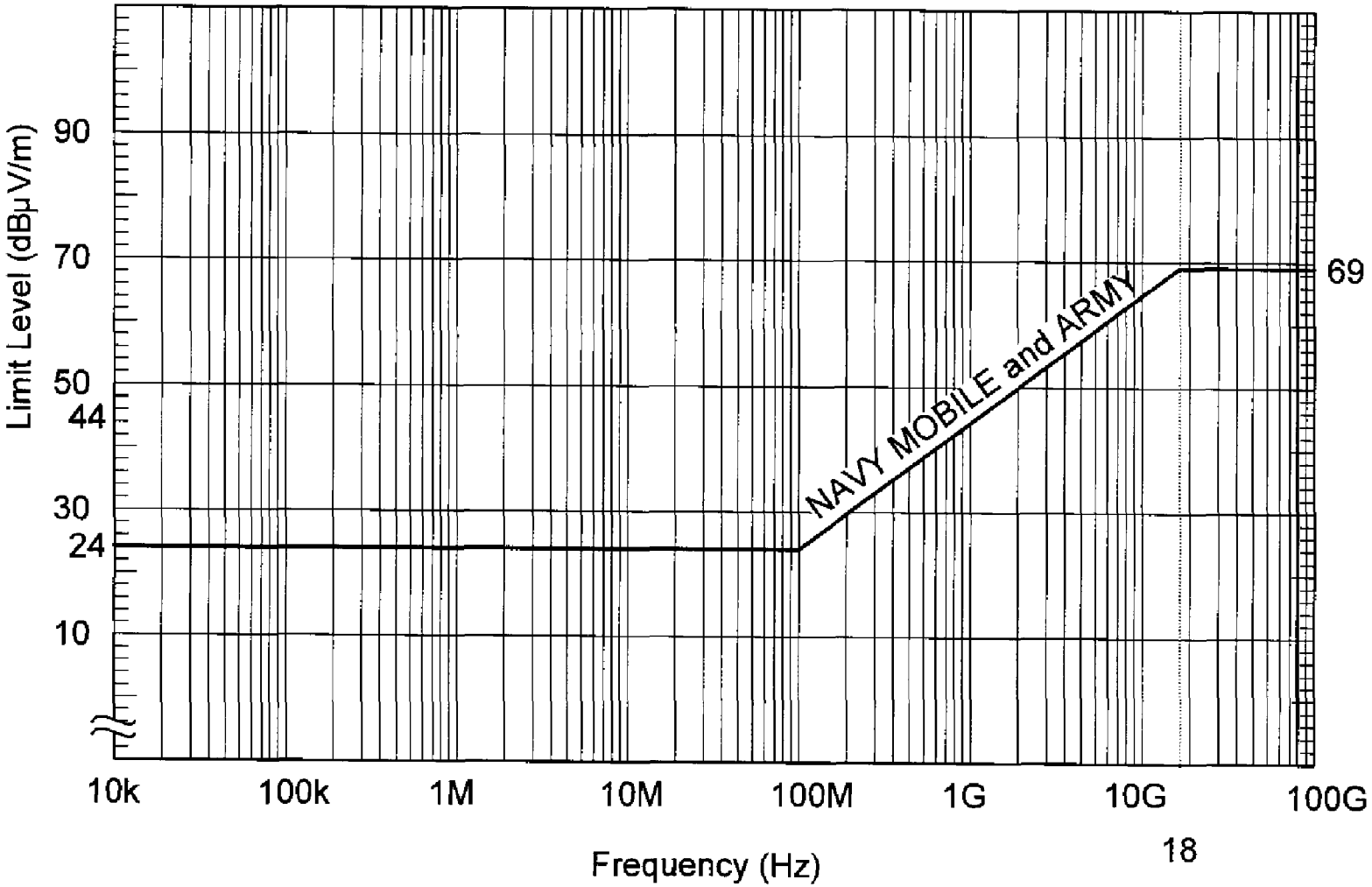
FIG. 3 is a graph illustrating certain military requirements for radiated emissions applicable to the work light.

Referring now specifically to the drawings, a reduced emissions work light according to the present invention is illustrated in FIG. 1 and shown generally at reference numeral 10. The work light 10 has particular application for military use in special purpose tents, referred to as modular command post shelters (MCPS), and other mobile military shelters. FIGS. 2 and 3 are graphs illustrating military specifications for conducted and radiated emissions, respectively. The present work light 10 meets these specifications. The complete text outlining the military requirements for the control of EMI emissions is incorporated herein by reference. See MIL-STD-461D, Jan. 11, 1993, revised Jun. 19, 1997. Preferably, the work light 10 weighs between 3 and 5 pounds, and is manufactured in various lengths ranging from between 30 and 40 inches.

Figure 4:
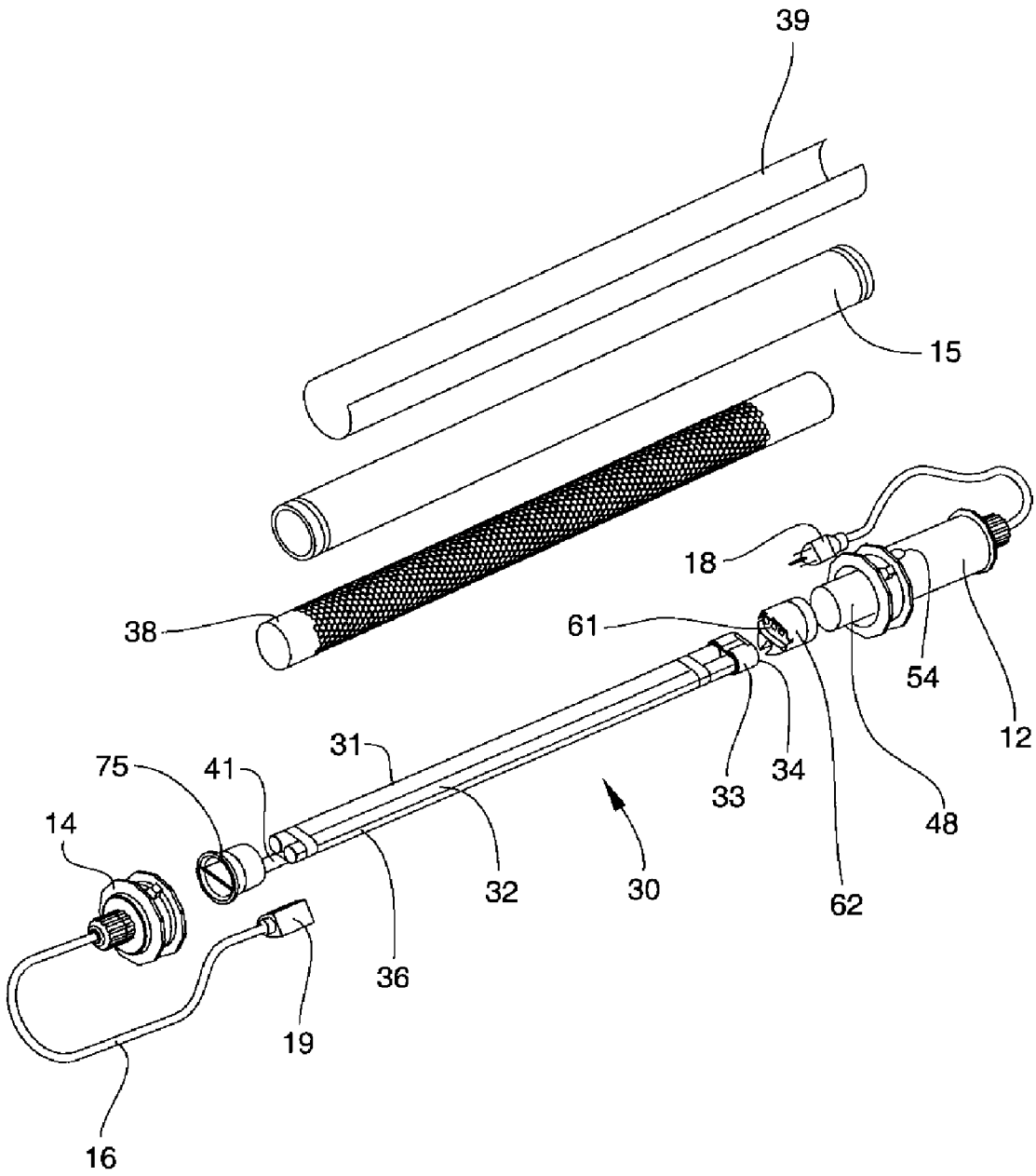
FIG. 4 is an exploded, fragmentary perspective view of the work light.
Figure 5:
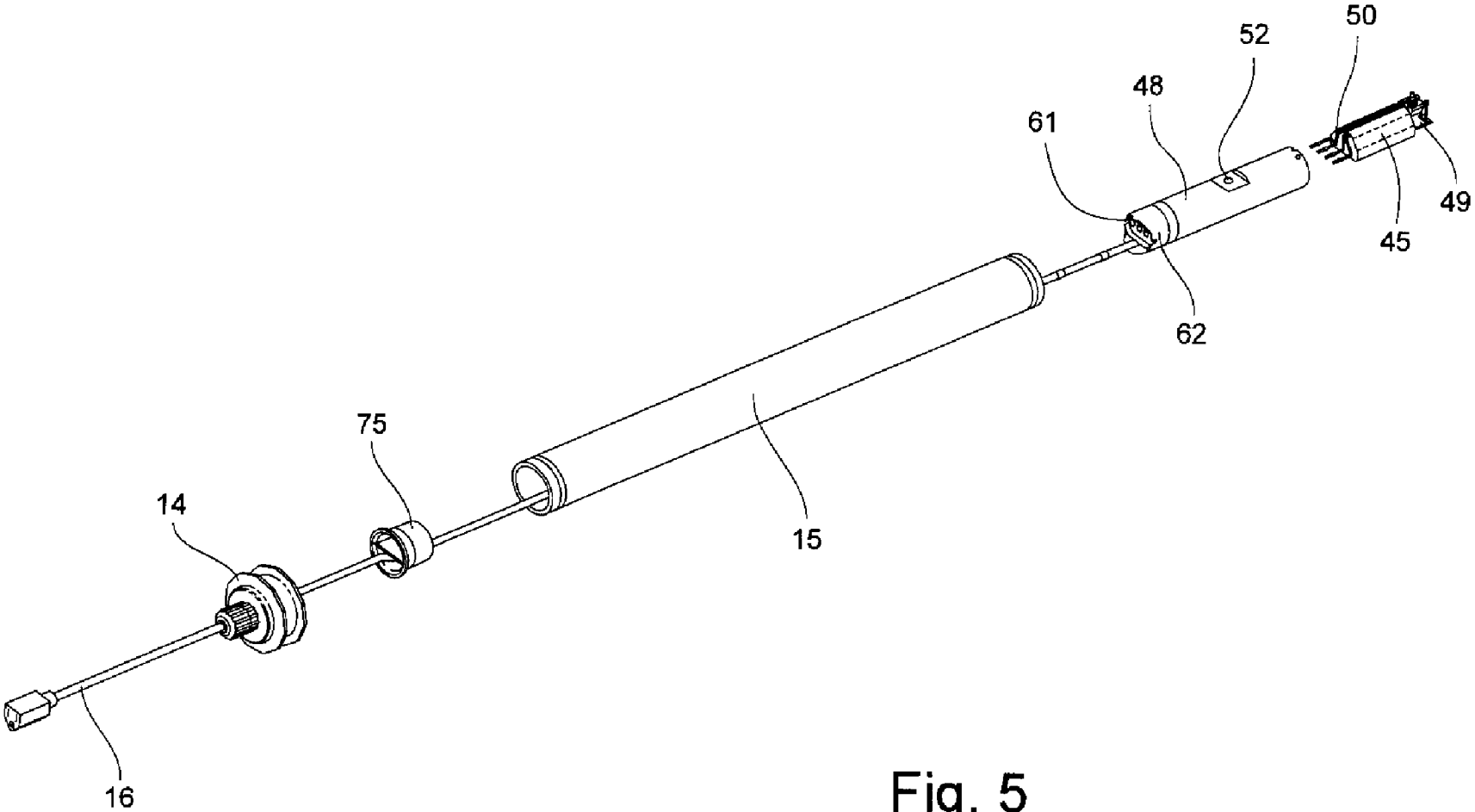
FIG. 5 is an exploded perspective view of the work light.
Figure 6:
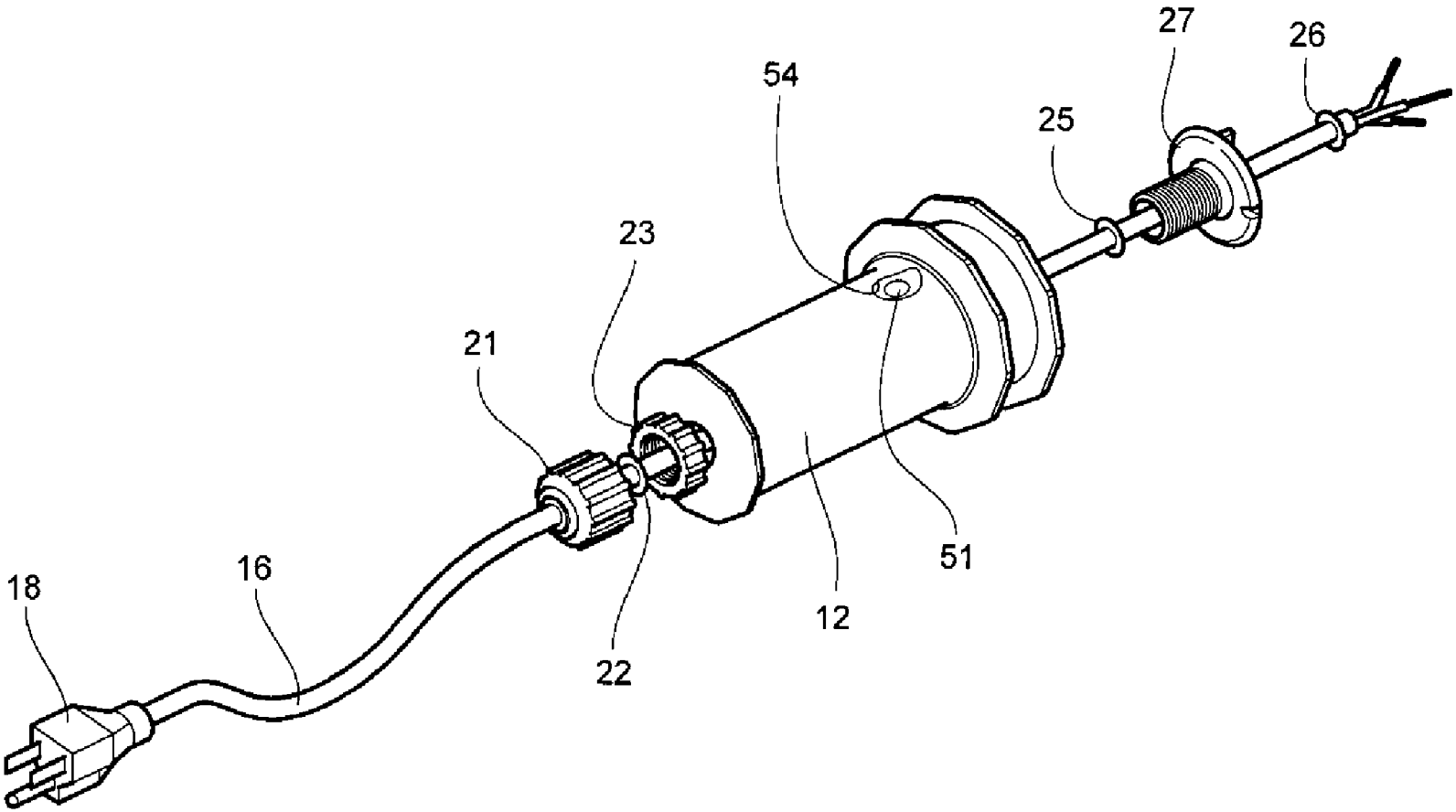
FIG. 6 is a partially exploded perspective view of the handle.

Referring to FIGS. 1, 4, 5 and 6, the work light 10 includes components, such as a shock-absorbing rubber handle 12 and end cap 14 and a light-transmitting bulb shield 15, designed to protect the light 10 from damage during transport and use. Although the handle 12 is specially designed for being gripped by a user, an alternative handle may comprise any extension formed adjacent one or both ends of the bulb shield 15, including an end cap 14. A power supply cord 16 extends through the work light 10, and includes respective male and female connectors 18 and 19 at opposite ends to allow connection of multiple lights together in series. As best shown in FIG. 6, a molded cap nut 21, sleeve insert 22, and jam nut 23 cooperate to provide cord strain relief at a distal end of the handle 12. Cord strain relief is provided at the opposite, proximal end of the handle 12 by rings 25 and 26 and molded disk 27.

Figure 7:
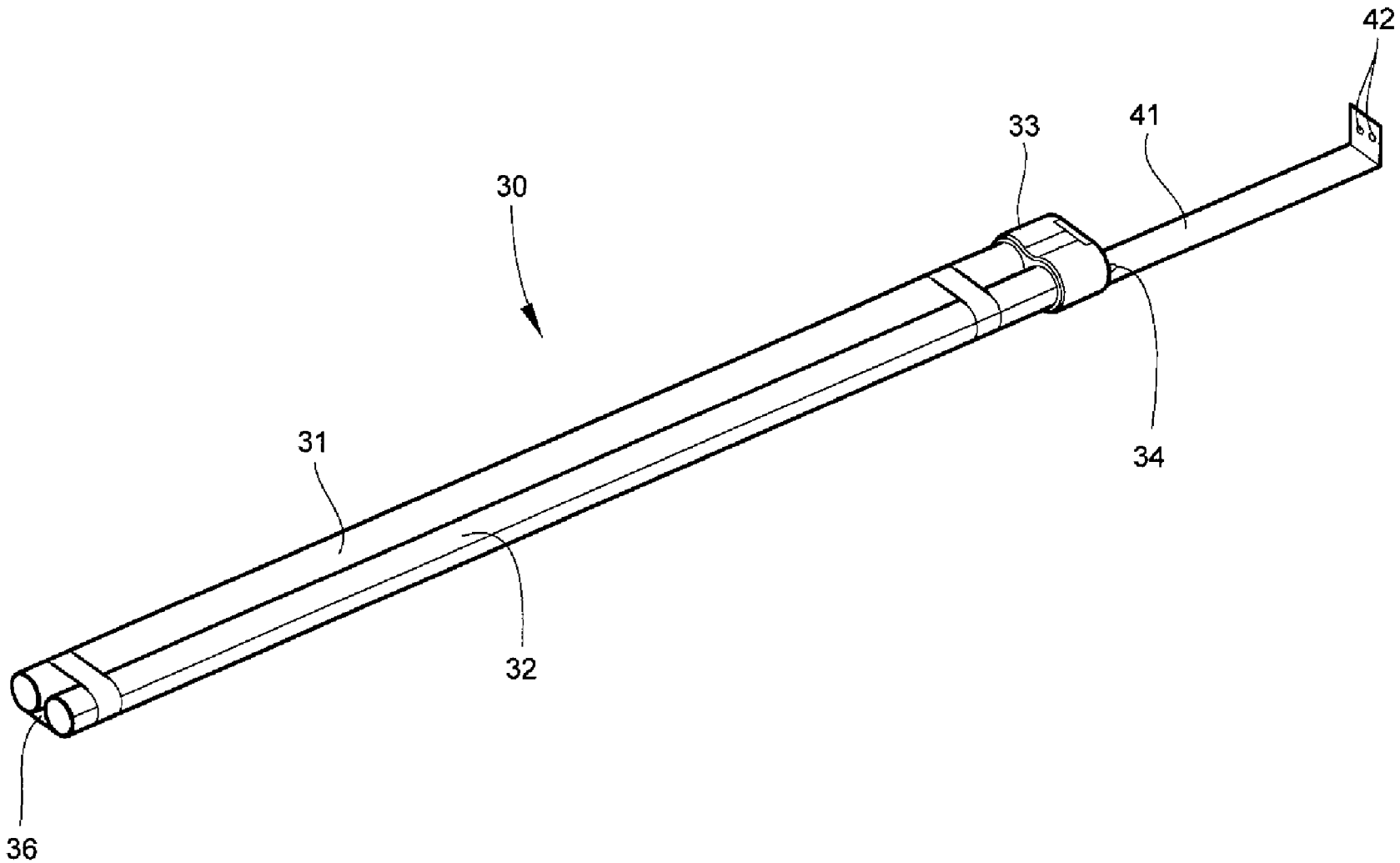
FIG. 7 is a perspective view of the flourescent bulb and pull strip.

The bulb shield 15 of the work light 10 is formed of a transparent, high-impact plastic. As shown in FIGS. 4 and 7, a replaceable bulb 30 is located inside the bulb shield 15 and includes a pair of elongated bulb tubes 31 and 32, a pin base 33, and electrode pins 34. According to one embodiment, the bulb 30 is a 50-Watt, phosphor-coated fluorescent bulb. For increased illumination, a white reflector 36 is preferably attached to the bulb tubes 31, 32. A perforated, tubular metal screen 38 surrounds the bulb tubes 31, 32 inside the bulb shield 15 and operates to reduce emissions generated during use of the work light 10. The exterior of the shield 15 is protected against scratching and scuffing by a removable color filter 39 suitably tinted to filter certain light emitted by the florescent bulb 30. This component of the work light 10 is fully described in the Applicant's U.S. Pat. No. 4,945,461 incorporated herein by reference.

A flexible pull strip 41 is located inside the bulb shield 15 for use in re-lamping the work light 10. The pull strip 41 is formed of a non-conductive, chrome-finished polymer material. One end of the pull strip 41 includes a reinforced portion with pin holes 42 adapted for receiving the electrode pins 34 of the bulb 30. The opposite end of the pull strip 41 extends slightly beyond the free end of the bulb 30 for convenient access. With a free end of the bulb shield 15 uncovered, the bulb 30 is removed from the work light 10 by gripping the end of the pull strip 41 and pulling in a direction away from the handle 12. The pull strip 41 is further described in Applicant's issued patent, U.S. Pat. No. 5,738,438, incorporated herein by reference.

Figure 8:
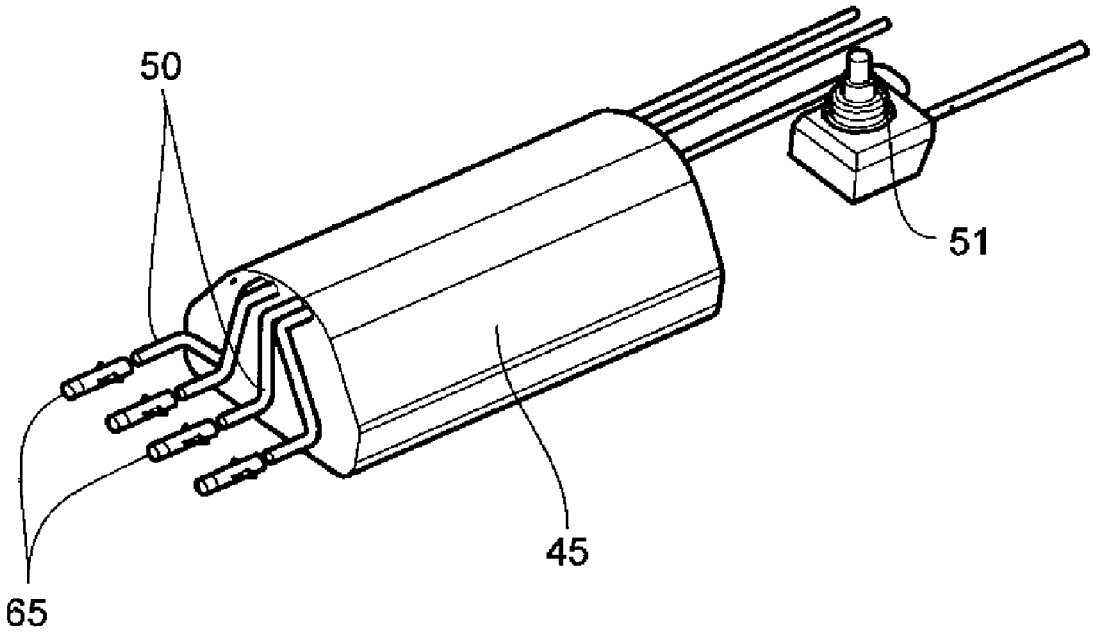
FIG. 8 is a perspective view of the ballast.
Figure 9:
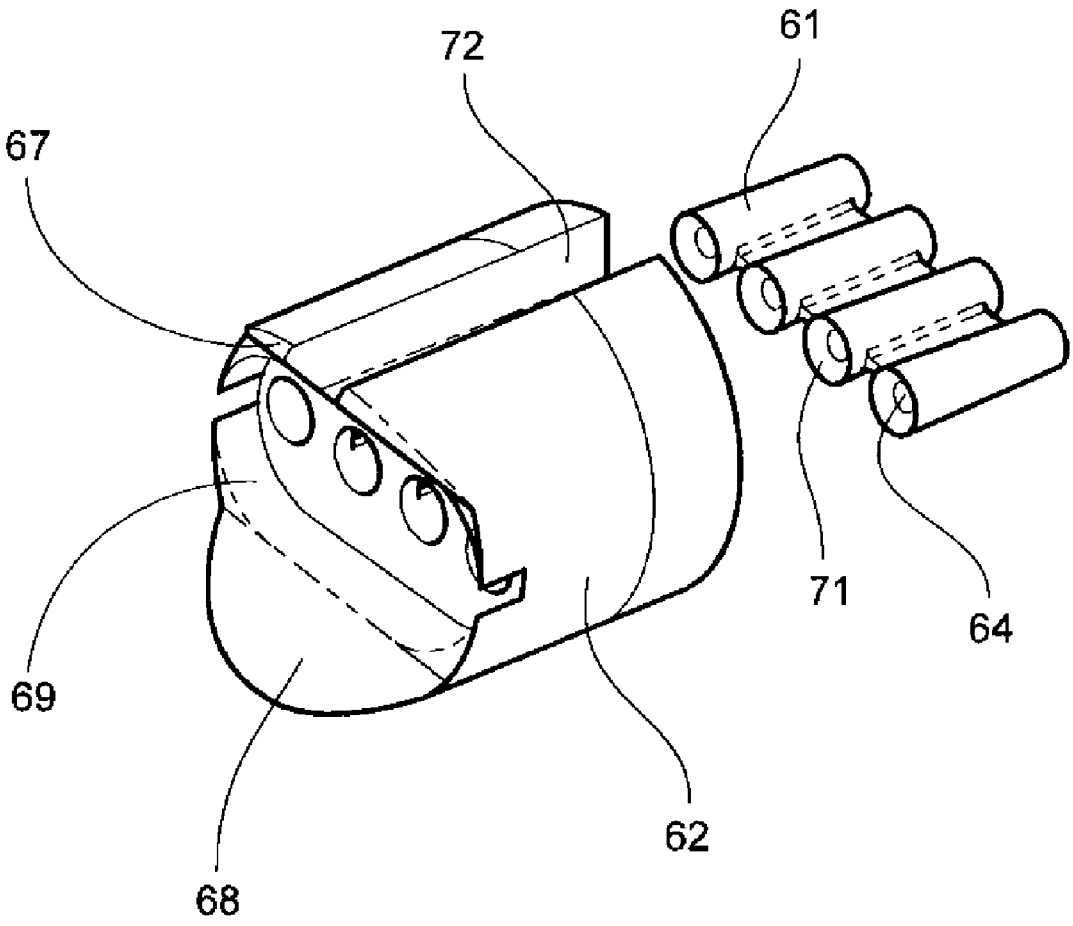
FIG. 9 is an exploded perspective view of the shock with the molded bulb socket.
Figure 10:
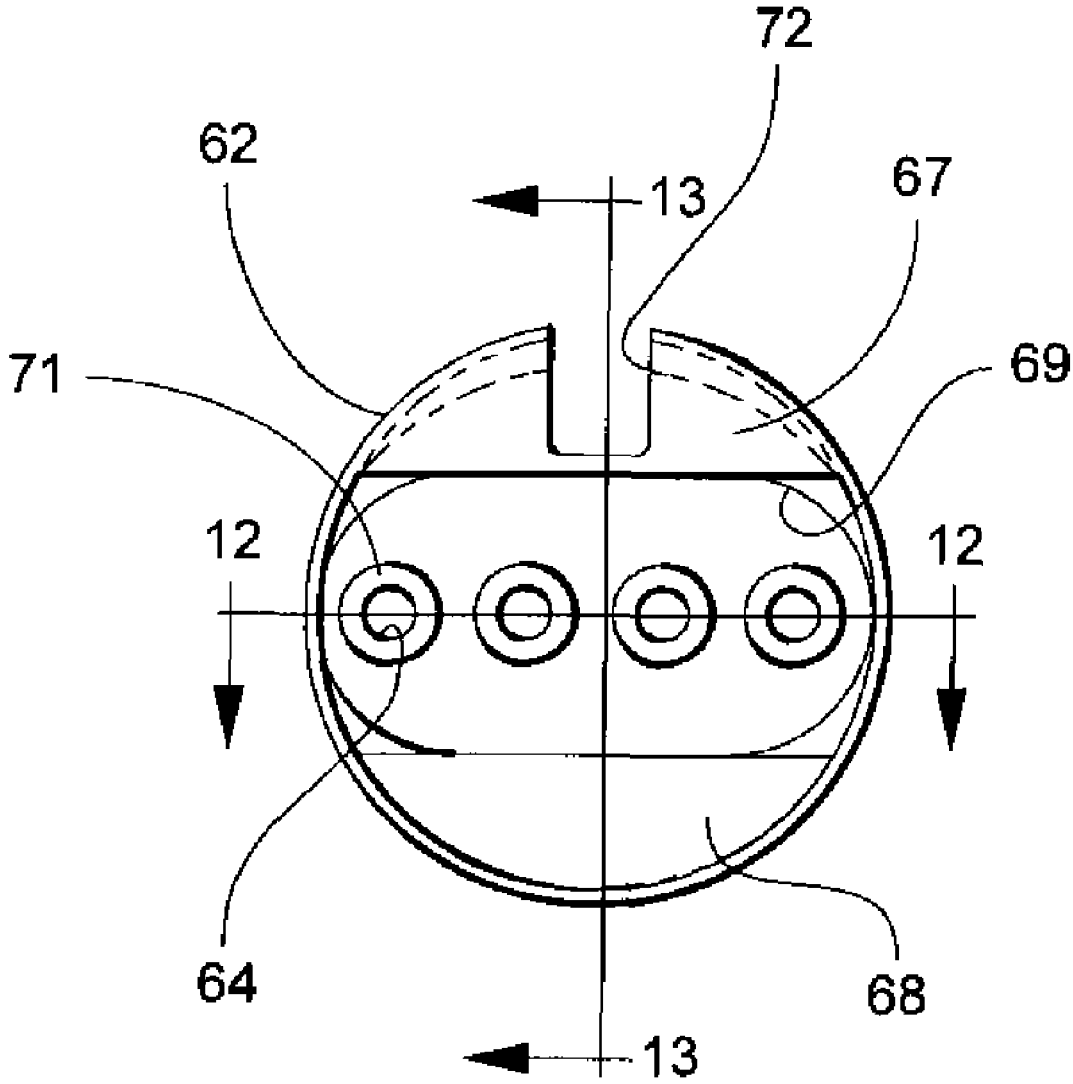
FIG. 10 is an end elevation of the bulb shock and socket.
Figure 11:
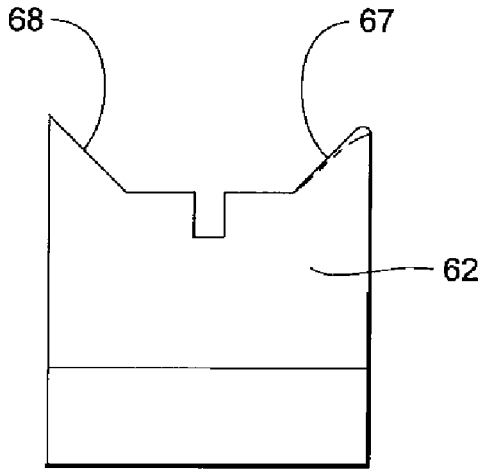
FIG. 11 is a side elevation of the bulb shock and socket.
Figure 12:
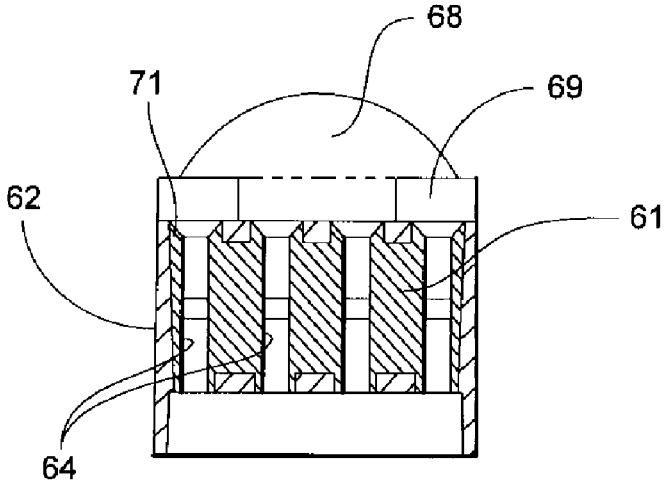
FIG. 12 is a cross-sectional view of the bulb shock and socket taken substantially along line 12-12 of FIG. 10.
Figure 13:
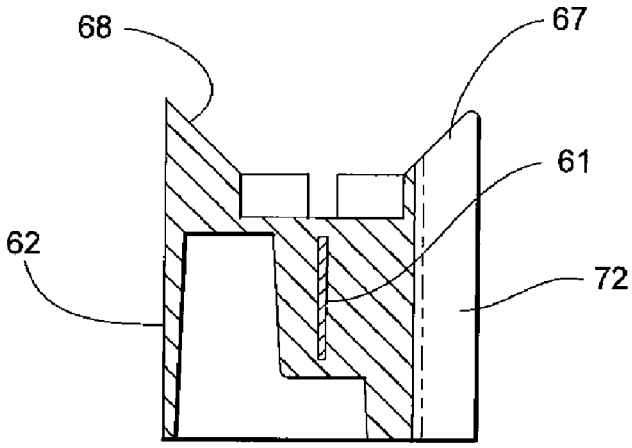
FIG. 13 is a cross-sectional view of the bulb shock and socket taken substantially along line 13-13 of FIG. 10.
Figure 14:
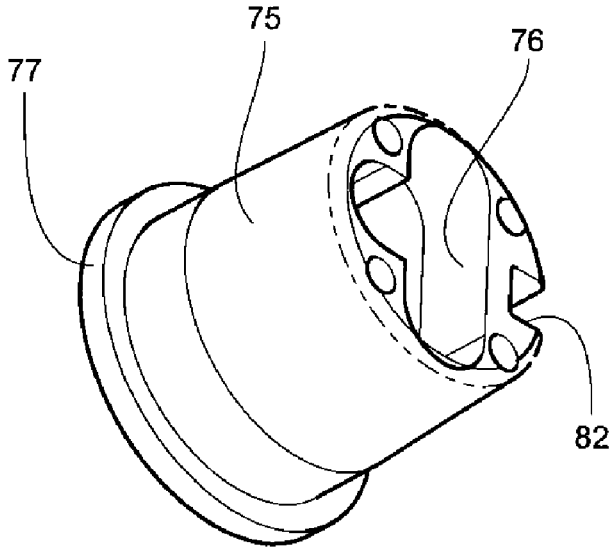
FIG. 14 is a perspective view of the shock-absorbing end plug.
Figure 15:
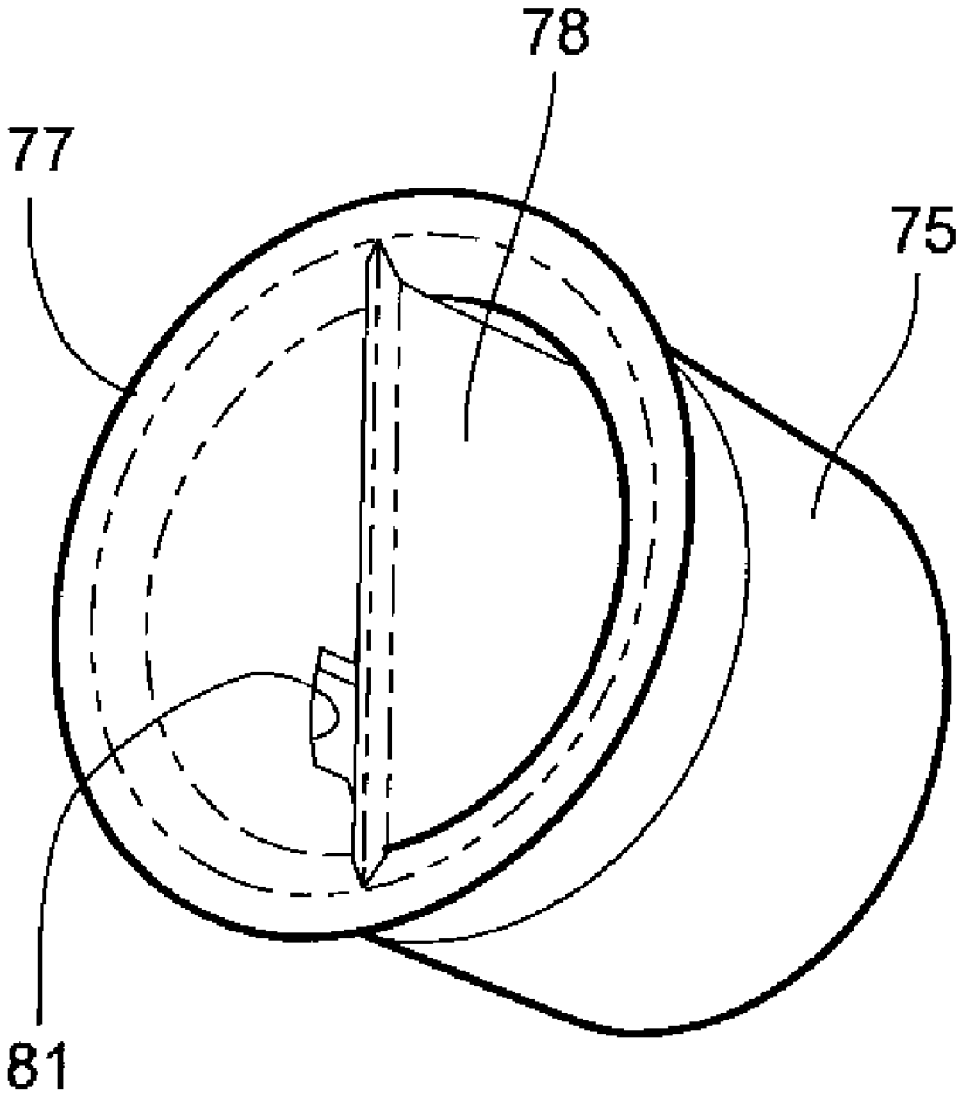
FIG. 15 is a second perspective view of the end plug.
Figure 16:
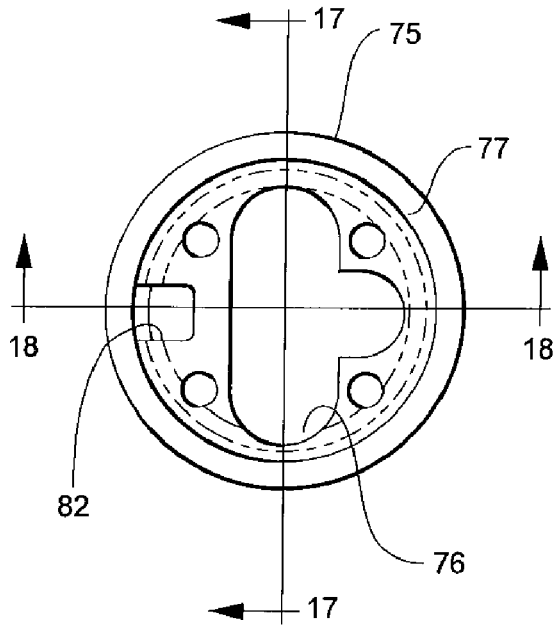
FIG. 16 is an end elevation of the end plug.
Figure 17:
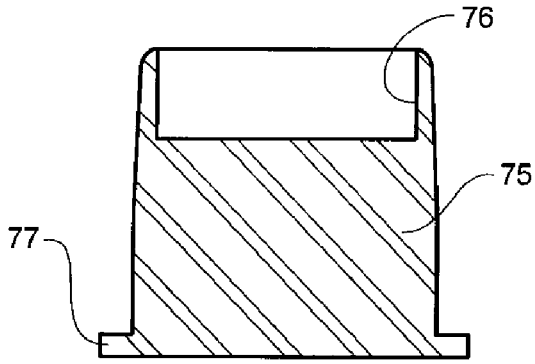
FIG. 17 is a is a cross-sectional view of the end plug taken substantially along line 17-17 of FIG. 16.
Figure 18:
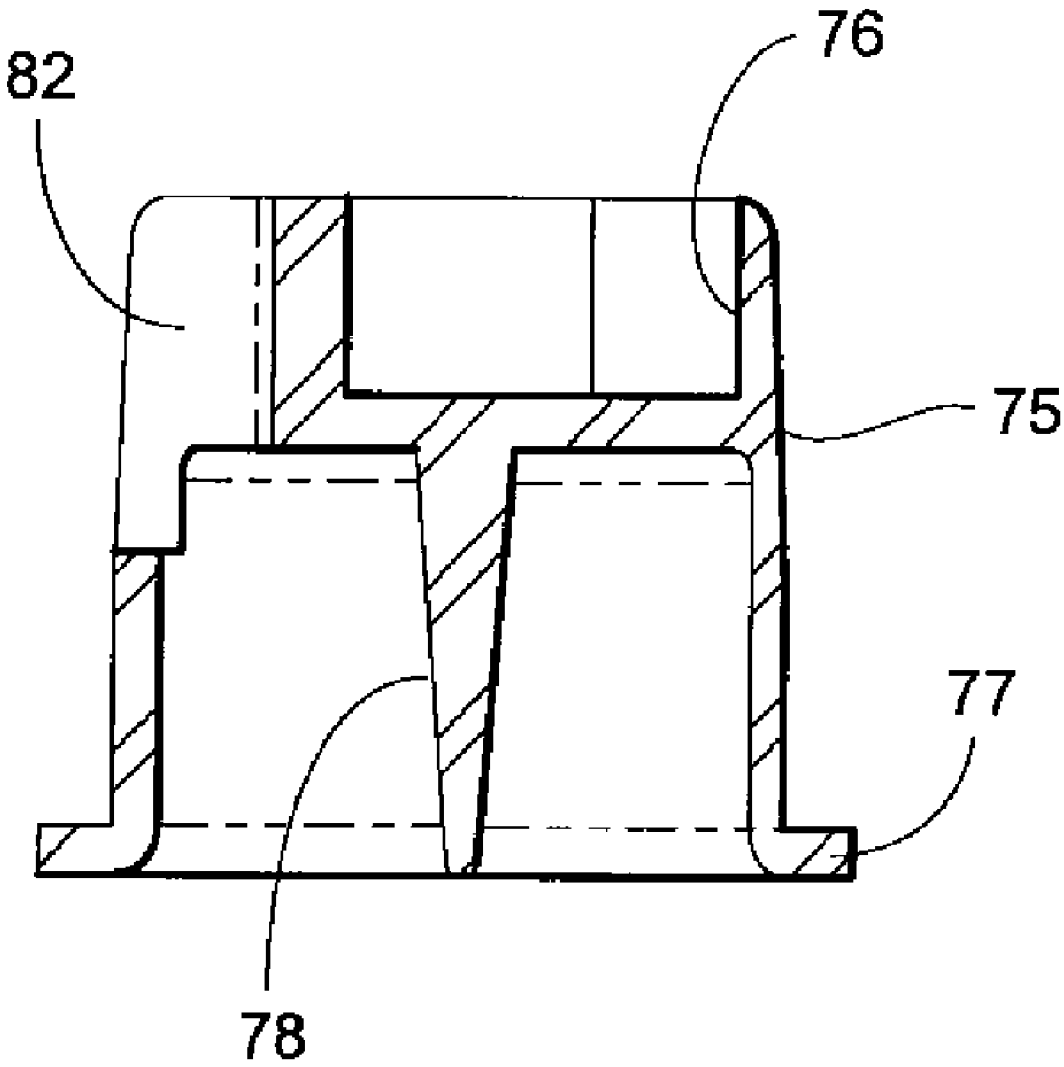
FIG. 18 is a cross-sectional view of the end plug taken substantially along line 18-18 of FIG. 16.

As shown in FIGS. 5 and 8, an electronic ballast 45 with an integrated emissions filter is stored in a containment housing 48 located within the handle 12 of the work light 10. Ballast wires 50 connect the ballast 45 to the bulb 30. According to one embodiment, the emissions containment housing 48 is an open-ended cylindrical metal cup designed to fit entirely within the handle 12, and extend into an open end of the tubular metal screen 38. The proximal ends of the metal screen 38 and metal housing 48 engage each other in a close, wedged fit to provide continuous grounding, and to prevent the escape of emissions between the screen 38 and housing 48.

The ballast 45 has multiple voltage capability that allows operation from 50-60 Hz and an input source of 120 V to 240 V. The ballast 45 includes a zener diode which conducts when the input voltage is high enough, thus activating a transistor coupled to the zener diode. A phototriac switch is in the "on" position when the ballast is receiving a low voltage input, but the switch turns to the "off" position in a high voltage configuration. The zener diode, transistor and phototriac switch are contained on the printed circuit board encapsulated inside an asphalt molding located within the ballast 45. In the initial start-up phase, the ballast 45 automatically senses the input voltage but will increase the voltage when the voltage reaches a set point, which eliminates the need for a fuse. During operation, when the voltage reaches a break point, the ballast 45 switches to a higher voltage range, i.e. 120 Volts to 240 Volts, when the transistor is activated by the zener diode conduction turning the phototriac switch to the "off" position.

A varistor is also included on the printed circuit board located within the ballast 45. Preferably, a metal oxide varistor (MOV) is used that contains a mass of zinc oxide grains in a matrix of other metal oxides, sandwiched between the electrodes. When the voltage increases beyond an acceptable level, such as during a power surge, the varistor's resistance rapidly decreases, thus creating an alternative path for the voltage to travel which is grounded. The varistor protects the electrical components of the work light 10 from the potential harmful effects of a large transient voltage or power surge for which the ballast 45 cannot compensate.

For convenient activation of the work light 10 at the handle 12, the ballast 45 includes an activation switch 51 extending through aligned openings 52 and 54 in the housing 48 and handle 12, respectively. The switch 51 enables independent operation of the work light 10 regardless of the number of other work lights connected together in series. When activated, the ballast 45 provides start-up voltage for the fluorescent bulb 30 and serves to limit the electric current through the work light 10.

Operation of the ballast 45 generates emissions which are substantially contained within the housing 48. The ballast 45 has an integrated emissions filter, containment housing 48, and perforated screen 38 which cooperates to reduce both radiated and conducted emissions generated by the work light 10. The housing 48 and screen 38 is preferably formed of aluminum. According to one embodiment, the housing 48 is formed of 6061-T6 aluminum. The screen 38 is formed of 0.3003H14 aluminum, and is approximately 0.03 inches thick.

As illustrated in FIG. 8, the ballast 45 has a partially cylindrical shape which corresponds with the shape of the housing 48. This shape allows the ballast 45 to correspond with the housing 48 and occupy substantially all of the intended volume for an efficient use of space. These corresponding shapes also function to keep the ballast 45 secure to prevent unintended movement resulting in damage.

Referring to FIGS. 4 and 5, a molded bulb socket 61 and rubber shock 62 are located at a proximal end of the containment housing 48 between the electrode pins 34 of the bulb 30 and wires 50 of the ballast 45. As best shown in FIGS. 9-13, the bulb socket 61 is formed of a hard plastic material molded directly within the body of the shock 62. A number of longitudinal bores 64 extend through the bulb socket 61, and are adapted to interconnect respective pins 34 of the bulb 30 and wires 50 of the ballast 45. Barbed connectors 65 (See FIG. 8) are provided at terminal ends of the ballast wires 50 and are adapted for being inserted into a first end of the socket 61 through respective bores 64. The electrode pins 34 of the bulb 30 are inserted into the opposite end of the socket 61 through bores 64 to engage connectors 65. The rubber shock 62 provides impact resistance to further protect the bulb 30 from breaking if the work light 10 is dropped or damaged, and protection against vibration and loose cargo situations in its field application. According to one embodiment, the shock 62 is formed of an injection molded or extruded, medium hardness thermoplastic elastomer, such as PVC nitrile.

To facilitate proper placement of the bulb 30, the shock 62 has opposing, inwardly-tapered side walls 67 and 68 defining a guide recess for directing the bulb pins 34 into the through-bores 64 of the socket 61. The lower perimeter 69 of the guide recess is preferably contoured to secure the pin base 33 of the bulb 30. The mouth 71 at each through-bore 64 of the socket 61 defines an enlarged, generally conical opening adapted to readily accept the bulb pins 34. In addition, because the socket 61 is formed of a hard molded plastic, the bulb pins 34 engage the socket 61 at the enlarged conical openings and slide into respective through-bores 64 without friction interference. While the bulb socket 61 is preferably molded separately inside the rubber shock 62, as described and shown, the bulb socket 61 and shock 62 may be integrally-formed together as a single unit. A longitudinal channel 72 is formed along one side of the shock 62 to accommodate passage of the power supply cord 16 through the interior of the work light 10.

Figure 19:
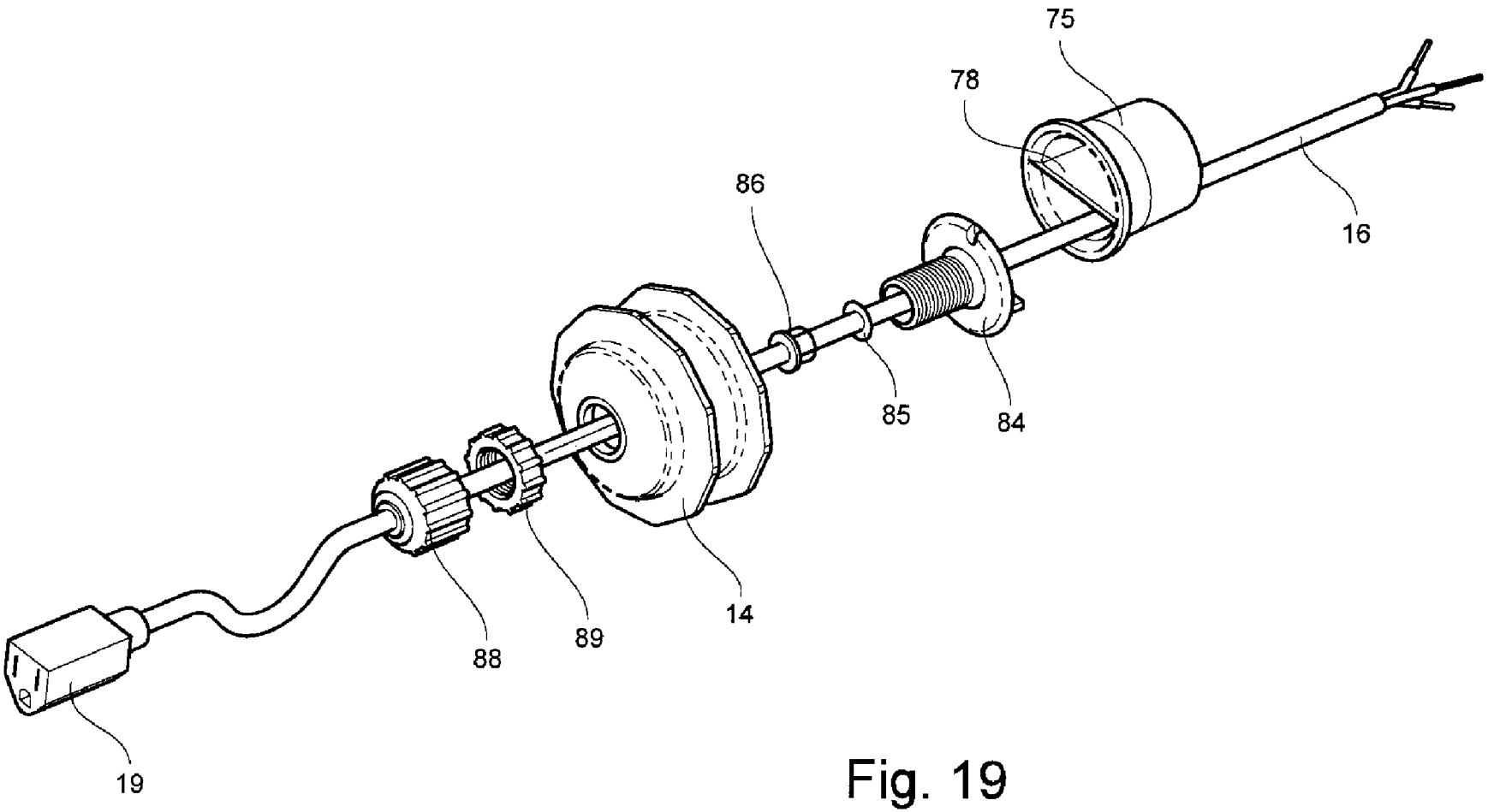
FIG. 19 is an exploded perspective view showing the end cap, plug, and various strain relief components.

Referring again to FIGS. 4 and 5, a removable shock-absorbing plug 75 is located at the opposite end of the bulb shield 15 adjacent the end cap 14. The plug 75 engages and surrounds the free end of the bulb 30 inside the shield 15, and further protects the bulb 30 from damage caused by sudden impact to the work light 10. As best shown in FIGS. 14-18, the plug 75 has a first end which defines a contoured opening 76 adapted to receive the free end of the bulb 30. The opposite end of the plug 75 is recessed, and includes an annular flange 77 for engaging the annular peripheral edge of the bulb shield 15. An interior web 78 is formed in the recessed area of the plug 75, and is designed for being gripped by a user to conveniently remove the plug 75 from the shield 15 to access the bulb 30. To accommodate passage of the power supply cord 16, an opening 81 and channel 82 are formed in the side wall of the plug 75. As shown in FIG. 19, a molded disk 84, O-ring 85, and sleeve insert 86 are located between the end cap 14 and plug 75 to provide cord strain relief. A molded cap nut 88 and jam nut 89 cooperate on the other side of the end cap 14 for added strain relief. According to one embodiment, the plug 75 is formed of an injection molded or extruded, medium hardness thermoplastic elastomer, such as PVC nitrile.

Figure 20:
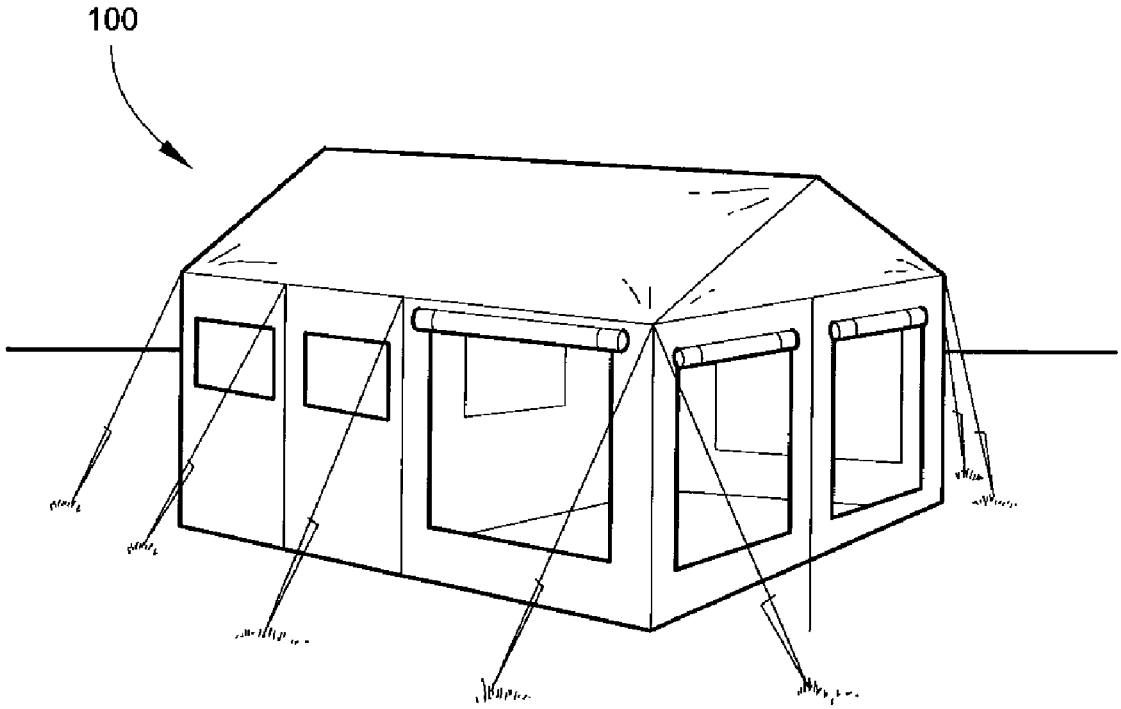
FIG. 20 illustrates a mobile shelter system including one or more of the work lights.

FIG. 20 illustrates a mobile shelter system 100. One or more of the work lights 10 are located within the shelter system 100 and suspended from overhead rods or straps to provide a convenient, energy efficient lighting system. The shelter system may be a military MCPS, or any other such tent or enclosure.

For convenient assembly and disassembly, the components of the work light 10 include complementary snap-together attachment elements enabling ready access to and replacement of worn or damaged parts. In addition, all surface elements of the work light 10 are preferably non-conductive. The term non-conductive is defined as having sufficient dielectric to be considered non-conductive at voltages below 600 V AC. The work light 10 may also include one or more hanger hooks (not shown) for suspending the light from the overhanging support structure inside the tent or enclosure.

A reduced emissions work light is described above. Various details of the invention may be changed without departing from its scope. Furthermore, the foregoing description of the preferred embodiment of the invention and the best mode of practicing the invention are provided for the purpose of illustration only and not for the purpose of limitation—the invention being defined by the claims.

What is claimed is:

1. A reduced emissions work light, comprising;

(a) a bulb comprising an elongated bulb tube;

(b) a handle adjacent the bulb and adapted for being gripped by a user to manipulate the work light;

(c) an emissions containment housing positioned adjacent the bulb tube; and (d) an integrated ballast and emissions filter in a single unitary body that is located in the housing and operatively connected to the bulb for providing voltage to the bulb and reducing emissions generated by the work light, wherein the ballast comprises a zener diode, a transistor, a varistor and a phototriac switch all contained on a common circuit board for allowing operation from an input source of 120 V to 240 V.

2. A reduced emissions work light according to claim 1, and comprising a tubular, light-transmitting bulb shield surrounding the bulb tube to protect the bulb from damage.

3. A reduced emissions work light according to claim 2, and comprising a cylindrical shock-absorbing plug positioned within the bulb shield and engaging a free end of the bulb tube to further protect the bulb from damage.

4. A reduced emissions work light according to claim 3, wherein the plug includes an interior web for being gripped to remove the plug from the bulb shield.

5. A reduced emissions work light according to claim 2, and comprising a shock-absorbing end cap positioned over an end of the bulb shield opposite the handle.

6. A reduced emissions work light according to claim 1, and comprising a switch opening formed in the emissions containment housing to accommodate a ballast activation switch in the handle.

7. A reduced emissions work light according to claim 1, and comprising a removable color filter positioned over the bulb shield to filter light emitted by the bulb.

8. A reduced emissions work light, comprising:

(a) a bulb comprising an elongated bulb tube;

(b) a handle adjacent the bulb and adapted for being gripped by a user to manipulate the work light;

(c) an emissions containment housing positioned adjacent the bulb tube having a predetermined interior void; and (d) an integrated ballast and emissions filter in a single unitary body that is located in the housing and having an exterior shape substantially conforming with the interior void in the housing, whereby the integrated ballast and filter assembly occupies substantially all of the interior volume of the housing, and wherein the ballast comprises a zener diode, a transistor, a varistor and a phototriac switch all contained on a common circuit board for allowing operation from an input source of 120 V to 240 V.

9. A reduced emissions work light according to claim 8, wherein the ballast includes electrical wires having respective terminal ends operatively connected to respective pins of the bulb.

10. A reduced emissions work light according to claim 9, and comprising a bulb socket located between the fluorescent bulb and the ballast, the bulb socket defining a plurality of longitudinal through-bores receiving respective wire ends of the ballast from a first end thereof and respective electrode pins of the bulb from an opposite second end thereof.

11. A reduced emissions work light according to claim 10, wherein the bulb socket comprises enlarged conical openings at the first end thereof, the enlarged openings adapted for receiving respective electrode pins into the longitudinal through-bores.

12. A reduced emissions work light according to claim 10, wherein the bulb socket is formed of a molded plastic material.

13. A reduced emissions work light according to claim 10, and comprising a cylindrical resilient shock formed around the bulb socket at an open proximal end of the cup.

14. A reduced emissions work light comprising:

(a) a bulb comprising an elongated bulb tube;

(b) a handle adjacent the bulb and adapted for being gripped by a user to manipulate the work light;

(c) an emissions containment housing positioned adjacent the bulb tube having a predetermined interior void;

(d) an integrated ballast and emissions filter in a single unitary body that is located in the housing and having an exterior shape substantially conforming with the interior void in the housing, whereby the integrated ballast and emissions filter assembly occupies substantially all of the interior volume of the housing; and (e) a zener diode, a transistor, a varistor and a phototriac switch all contained on a common circuit board encapsulated inside an asphalt molding in the ballast for allowing operation from an input source of 120 V to 240 V.

15. A reduced emissions work light according to claim 14, and comprising a light reflector located adjacent the bulb tube for enhancing illumination of the bulb.

16. A reduced emissions work light according to claim 14, and comprising an elongated pull strip releasably attached to the bulb for removing the bulb from the work light for replacement.

17. A reduced emissions work light according to claim 14, and comprising a power supply cord adapted for being connected to a power source to supply electrical power to the work light.

* * * * *